US005415406A

United States Patent [19]

Reichenbach et al.

[11] Patent Number: 5,415,406

[45] Date of Patent: May 16, 1995

[54] GOLF CLUB SWING TRAINING DEVICE

[76] Inventors: Roy A. Reichenbach; Norma J. Reichenbach, both of 2245 N. Moonlite Dr., Las Vegas, Nev. 89115

[21] Appl. No.: 106,090

[22] Filed: Aug. 16, 1993

[51] Int. Cl.[6] ..... A63B 69/36

[52] U.S. Cl. ..... 273/186.2; 273/194 R

[58] Field of Search ..... 273/193 A, 194 R, 187.4, 273/186.2; 482/109, 111

[56] References Cited

U.S. PATENT DOCUMENTS 3,565,444 2/1971 LaRocca ..... 273/194 R X
5,002,275 3/1991 Beutler et al. ..... 273/193 A X
5,184,825 2/1993 Ruth ..... 273/186.2
5,310,188 5/1994 Hernberg ..... 273/186.2

*Primary Examiner*—George J. Marlo

[57] ABSTRACT

A golf device comprising a golf club having a club head and a club shaft, said club head having a face, an attachment adjacent the base of said club shaft, said attachment comprising a flexible, unitary, air-resistant blade having a channel extending the length of said blade along its center line, said club shaft being rotatably mounted in said channel so that the blade including the outer surface of said channel are aligned parallel to the face of the club head, said mounting being such that the blade will stay in the mounted position on the golf club shaft or will rotate depending on how the golf club is swung.

5 Claims, 3 Drawing Sheets

GOLF CLUB SWING TRAINING DEVICE

BACKGROUND - FIELD OF INVENTION

This invention relates to devices designed to facilitate monitoring, evaluation and improving a golfer's swing and also relates to those devices used during practice sessions to develop additional power and control when swinging a golf club, and more specifically this invention relates to those devices that may also be used on the golf course to warm-up swing before hitting a shot during a match.

BACKGROUND DESCRIPTION OF PRIOR ART

Golfers, both amateur and professional, have used, and presently are using a number of devices and methods to warm-up before playing a shot . . . in addition to those devices and methods used to help develop more powerful and more precise golf swings. There are also specific devices being used to create more endurance and stamina in those body parts used in golfing. At least one device is presently being used to warm-up swing during match play and also used as a practice adjunct to help develop more power in a person's golf swing. Known as the weighted doughnut, it is described later herein. Other devices are used primarily only as a means of increasing the power developed in those body parts used in swinging a golf club and, as a result, increase the distance achieved when hitting a golf ball. The end objective is to lower a person's score by decreasing the number of strokes needed to play a round of golf.

Early attempts at a warm-up procedure (pre-swing exercise or warm-up procedure) did not include the use of any additional devices or attachments per se, but instead involved the use of several golf clubs, up to four, (4), in some cases, which were swung in unison by the golfer before taking his turn to play. The additional weight of the extra clubs created a more powerful swing when a single club was used, directly after practice swinging with the extra clubs. This warm-up technique was undoubtedly modeled after baseball players who practiced, or warmed-up, by swinging several bats simultaneously while in the on-deck circle awaiting their turn to bat during baseball games.

Also modeled after a baseball warm-up device and method, is the use of a weighted doughnut which is placed on the shaft of the golf club, resting on the club head at the hosel. Shaped like a doughnut, the weight is slipped onto the shaft at the grip end and slid into position on the club head. This device is presently the most widely used device by golfers of all levels and has the same effect as swinging several golf clubs at one time. The doughnut is removed after several warm-up swings and the golfer then swings the same club, lighter in weight, to hit the ball. The weighted doughnut is the most practical and simple device available at this time, to use for both warm-up swinging and in practice sessions, to build strength. While the weighted doughnut is used in conjunction with the actual club to be played, it has a number of drawbacks.

The weighted doughnut has a tendency to slip up and down the golf club shaft and that creates a variable weight balance problem when swinging a club with the doughnut. The weighted doughnut creates additional problems in that the additional weight is present during all phases of the golfer's swing and causes unwanted stress or work during those parts of the swing process, such as the back swing, when additional effort is not wanted. These side effects are counterproductive in developing the proper swing dynamics to attack a golf ball properly.

Practice clubs which have additional weight added to the club head are another means that golfers use to strengthen their swing, exercising by repeatedly swinging the weighted club while at the driving range, on the golf course or warm-up swinging. The weighted club device has counterproductive side effects just as the weighted doughnut. The extra weight being concentrated in the club head causes a weight imbalance problem during the backswing and follow through contributing to detrimental reactions affecting club head control and the accuracy of in-flight ball direction. The weighted club head has become most often used for warm-up purposes as opposed to swing technique improvement or strength development.

A number of other devices related to health club and body building equipment have been developed and are used to help golf enthusiasts strengthen their wrists, forearms, shoulder muscles and just about any part of the body imaginable. Most of these devices are simply exercise machines that have been Used by body builders as strengthening aids but are not specifically applicable to improving the dynamics of a golfer's swing. Developing a properly grooved golf swing requires working the various muscles, tendons and ligaments at specific times and at the proper resistance levels during the swing.

Progressive resistance has long been advocated as a means of strengthening body parts, as progressive resistance is controlled by the ability of the participant to engage the resistance. Up to this time there haven't been any golf club attachments that utilize the principle of progressive air resistance to accomplish the building of additional strength in a golfer's body parts or to warm-up swing before playing. One device swung like a baseball bat is available that uses the principle of progressive air resistance to increase strength in body parts. The device, called a "Power Swing" utilizes four plastic fins attached to a baseball bat to incorporate the principle of progressive wind resistance to create a means of increasing the effort required to swing the device. The Power Swing is swung in the same manner as a golf club. It is claimed to increase the strength of the golfer's swing. If used in a daily workout routine it would seem that body strengthening would occur. However, the device is too large and cumbersome to be used on the golf course and therefore cannot be used as a warm-up device. Because the Power Swing is not used in the manner of a golf club, nor even held with the same grip as a golf club, it would become obvious that it would not have the same effect as swinging a golf club incorporating the advantages of progressive wind resistance, to develop a properly grooved swing.

The aforementioned golf-swing improvement and power improvement devices all suffer from the basic disadvantages of;

1. Not performing during specific time periods when it is most advantageous in affecting both strengthening procedures and swing accuracy improvement procedures which result in increased control of ball direction and distance.
2. Being difficult or impossible to use for both warm-up as well as an exercise attachment for the use with the actual golf club to be used on the golf course, the driving range or any place a golf club may be swung.

3. Not having a multiplicity of uses so that one piece of equipment may be used to accomplish as many objectives as required without having to change equipment.

OBJECTIVES AND ADVANTAGES

Besides the objectives and advantages that are apparent in the specifications described in my above patent, other objectives are:

(a) To provide a device that can be used by golfers of any level, gender or age group, on the golf course or driving range, that can easily be attached to any golf club for the purpose of warm-up or pre-play practice swinging.

(b) To provide a device that can be used in conjunction with practice workouts off or on the golf course, that will strengthen those body parts used in swinging a golf club in a specific manner, resulting in a more powerful, precise swing, without interfering with the mechanics of a golfer's swing.

(c) To provide a lightweight device that uses the principle of progressive-air-resistance, that when attached to any golf club, provides a method to increase the strength in the users muscles, ligaments and tendons used in swinging a golf club.

(d) To provide a device that can be used to monitor the technical aspects of a golfer's swing procedure.

(e) To provide a device that can be used to monitor the technical aspects of a golfer's swing-procedure during actual playing circumstances.

(f) To provide a device that may be used during actual match play that gives the user information enabling him to make corrections to produce a more effective and powerful swing.

(g) To provide a means of attaching a progressive-air-resistance device to any golf club shaft, in a manner so that the device is held in place firmly and will not become detached during use, without affecting the mechanics of club use.

(h) To provide a device that attaches to a golf club in such a manner that it will rotate on the club shaft only under specific swing dynamics so as to provide the user with information about their swing technique.

(i) To provide a device that attaches to a golf club in such a manner that it will not rotate on the golf club shaft, if the dynamics of the user's swing follow a specific technique or procedure.

(j) To provide a device that attaches to a golf club that in the event it should be loosened during use, is designed to minimize the possibility of injury to the user or bystanders.

(k) To provide a device that attaches to a golf club in such a manner so as to have as remote a possibility as feasible of release from the golf club during use.

(l) To produce a device that may be used as a warm-up or exercise device by golfers that will not have unwanted counterproductive side effects.

(m) To provide a simple-to-use, inexpensive golf-swing-improvement device that may be used without the need of expensive exercise equipment.

(n) To provide a simple-to-use, inexpensive device that can be used as a strength building tool, by members of all levels of play, both male and female, of any age group or of any physical stature.

(o) To provide a dual-purpose exercise/warm-up device that will be low cost, long lasting, and maintenance free.

(p) To provide a lightweight device that attaches or detaches from a golf club shaft, easily and quickly.

(q) To provide a lightweight device that, when not in use, stores in a golfer's pocket, golf bag or golf cart.

DRAWING FIGURES

In the drawings, closely related figure have the same number but different alphabetic suffixes.

FIG. 1 is a frontside view of the Air-Resistance-Wing showing the tail section, head section and the clamping channel.

FIG. 2 is an end view of the Air-Resistance-Wing as perceived from the widest point of the bottom end of the body section of the Air-Resistance-Wing.

Figure 3A:
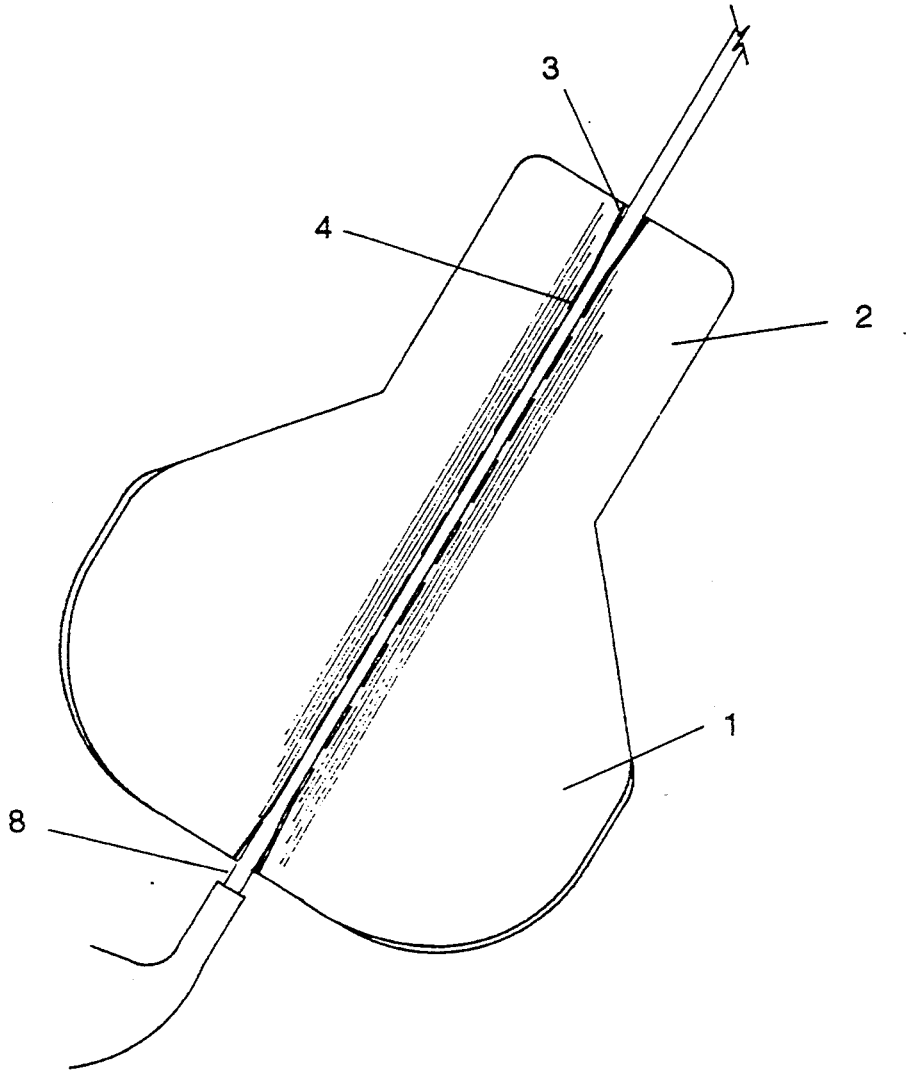

FIG. 3*a* is a view of the Air-Resistance-Wing as it appears after attachment to a golf club as perceived from the backside of the golf club.

Figure 4:
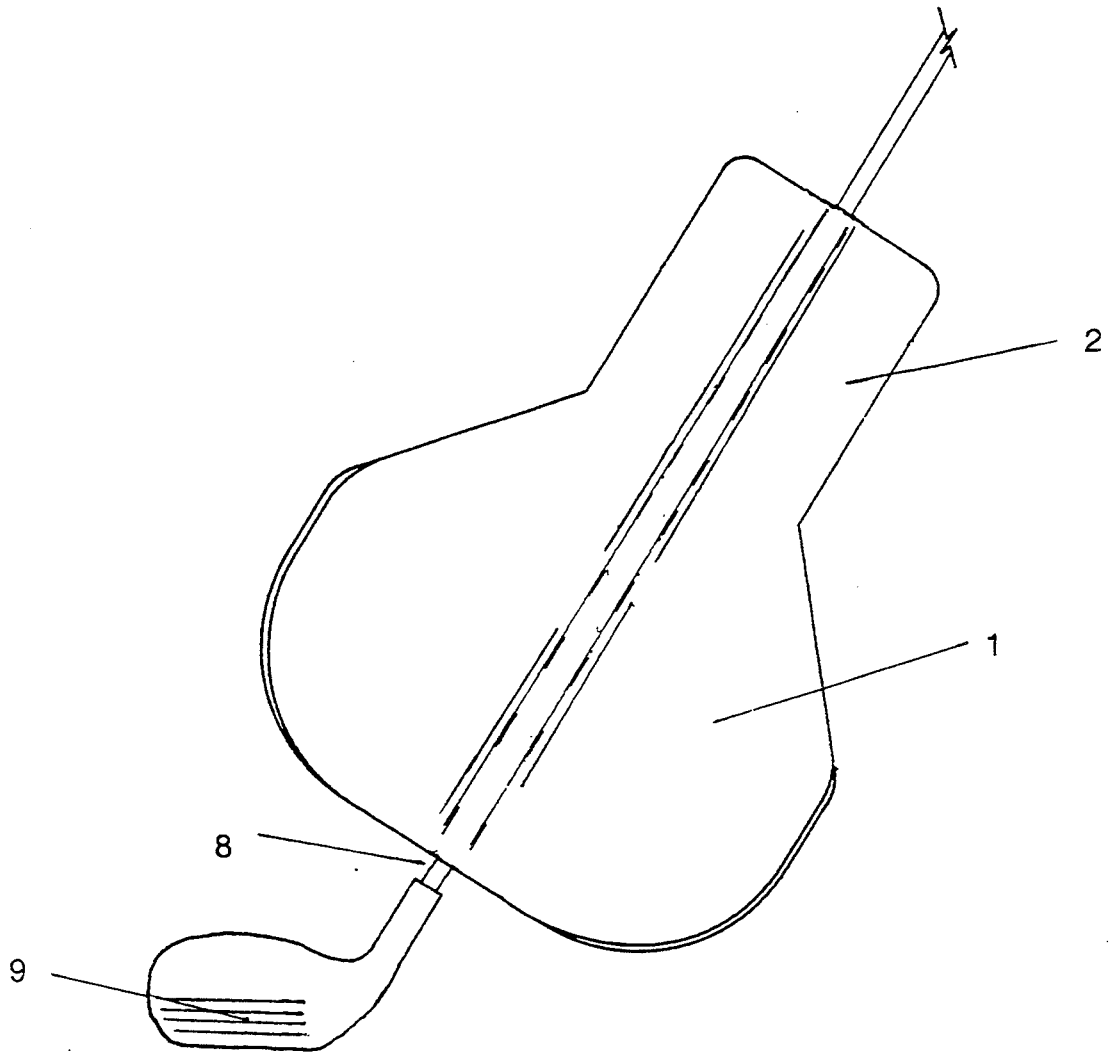

FIG. 4 is a view of the Air-Resistance-Wing as it appears attached to a golf club as perceived from the frontside of the golf club.

DETAILED DESCRIPTION OF THE INVENTION

As required, detailed embodiments of the present Air-Resistance-Wing are disclosed herein; however, it is to be understood that the disclosed embodiments are merely exemplary of the Air-Resistance-Wing, which may be embodied in various forms. Therefore, specific structural and functional details disclosed herein are not to be interpreted as limiting, but merely as a basis for the claims and as a representative basis for teaching one skilled in the art to variously employ the present Air-Resistance-Wing in virtually any appropriately detailed structure or form.

Figure 1:
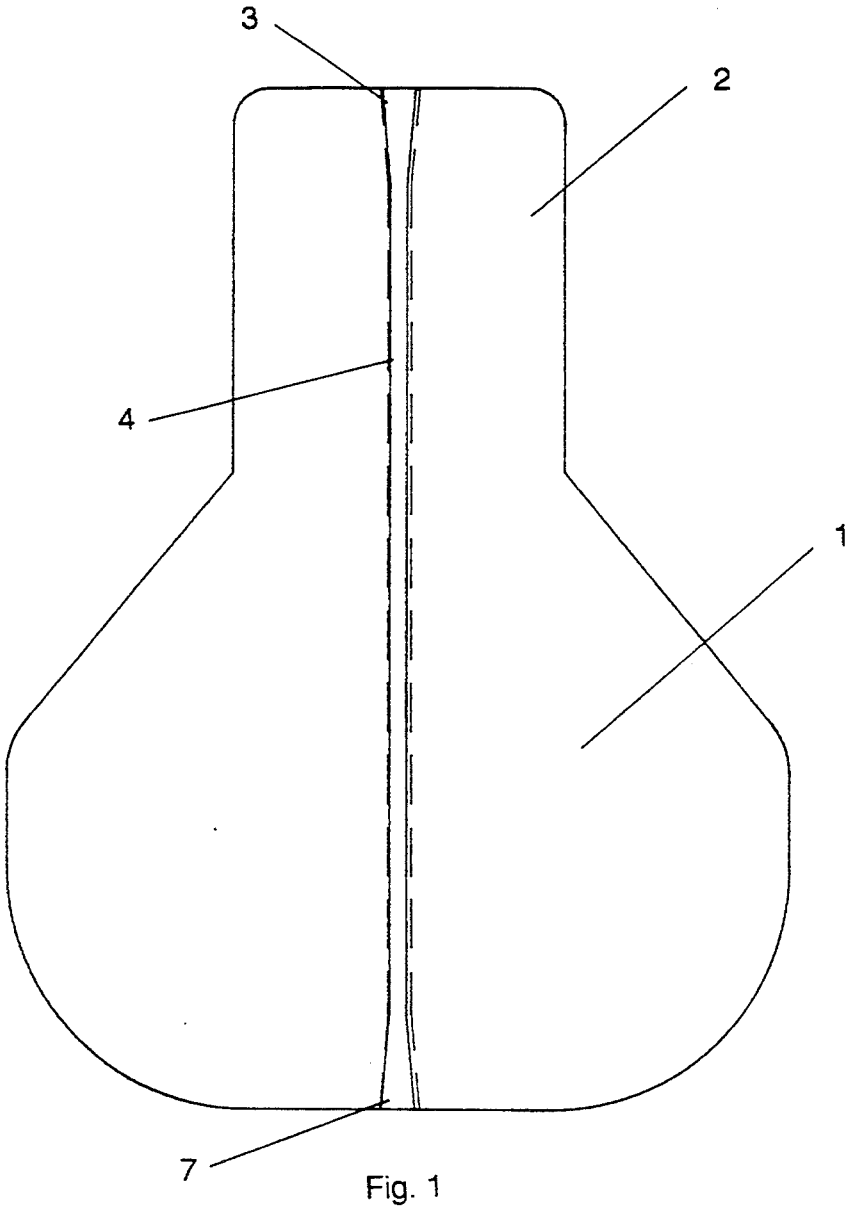
FIG. 1 to FIG. 4 show front, back and a perspective end view and various aspects of the Air-Resistance-Wing both attached to and detached from a golf club.
Figure 2:
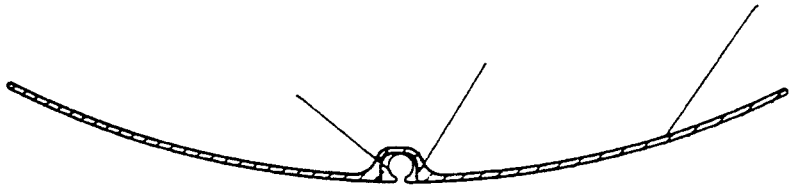

The reference numeral 1 generally designates an Air-Resistance-Wing (the invention) as it is adapted for attachment to a golf club shaft. The Air-Resistance-Wing as embodied in FIG. 1 is comprised of the BODY SECTION 1, the TAIL SECTION 2 and the CLAMPING CHANNEL 3. The Air-Resistance-Wing FIG. 1, is presently made of, but not limited to, a single piece of polypropolyne plastic, injection molded in this embodiment 0.080 of an inch in thickness. The Air-Resistance-Wing FIG. 1 is divided into two (2) sections, the head section 1*a* and the tail section 1*b*. The BODY SECTION 1 and the TAIL SECTION 2 form the one continuous piece of material of which the Air-Resistant-Wing FIG. 1 is made. A CLAMPING CHANNEL 4 runs the entire length of the Air-Resistance-Wing FIG. 1.

The Air-Resistance-Wing, in this embodiment, is in a slightly concave configuration of polypropolyne plastic with the BODY SECTION 1 being the widest portion and the TAIL SECTION 2 being the narrowest portion. The TAIL SECTION 2 is merely a continuation of the BODY SECTION 2 which tapers to the smaller dimension.

The CLAMPING CHANNEL 4 of said Air-Resistance-Wing is formed along the center line and runs full length of the Air-Resistance-Wing FIG. 1. The CLAMPING CHANNEL 4 is formed with and as part of the single sheet of material used to make the Air- Resistance-Wing FIG. 1. The CLAMPING CHANNEL 4 is flared approximately 5 degrees at each END OF CLAMPING CHANNEL 3 to facilitate aligning the Air-Resistance-Wing FIG. 1 when it is being attached to a GOLF CLUB SHAFT 8.

The surface of the INSIDE WALL OF THE CLAMPING CHANNEL 7 is a rough matt finish to provide additional friction that a smooth finish surface would not, thereby providing greater clamping tenacity helping hold the Air-Resistance-Wing FIG. 3*a* in the proper position during use. The Air-Resistance-Wing FIG. 3*a* is currently, but not limited to, injection molded polypropolyne plastic 0.080 inches thick to allow the Air-Resistance-Wing to flex when the golf club is swung, resulting in additional clamping pressure being exerted at the clamping surface the entire length of the CLAMPING CHANNEL 4, adding additional gripping force to help hold the Air-Resistance-Wing FIG. 1 onto the golf club shaft. The CLAMPING CHANNEL 4 grips proportionally tighter as the air pressure exerted against the Air-Resistance-Wing FIG. 3*a* by the moving golf club increases. The faster the golf club is swung, the tighter the grip of the Air-Resistance-Wing becomes. The Air-Resistance-Wing 3*a* will flex equally across its entire surface, if the golf club it is attached to is swung in a specific manner. The Air-Resistance-Wing 3*a* will also flex unequally across its entire surface, if the golf club it is attached to is swung in another specific manner. This causes the Air-Resistance-Wing 3*a* to stay in a fixed position on the golf club shaft, or to rotate, one direction or another, depending on the specifics of the way the golf club swung.

OPERATIONS—FIGS. 1-4.

The manner of using the Air-Resistance-Wing 3*a* to warm up is to attach the Air-Resistance-Wing to the golf club shaft of choice. The Air-Resistance-Wing 3*a* should be attached as close to the club head as possible, at the point where the hosel and the shaft meet 8. The device is attached by aligning the lead in edge of the CLAMPING CHANNEL 4 located at the bottom of the Air-Resistance-Wing 3*a* with the club head hosel and shaft 8 with the front of the Air-Resistance-Wing 3*a* square with the face of the CLUB HEAD 9 and pressed onto the shaft beginning at the CLUB HEAD 9 and working in an upward direction, toward the grip end of the club.

Once the Air-Resistance-Wing 3*a* is in position the golfer can commence swinging the club as though he were hitting a ball. The harder and more often the club is swung, the more power it takes to swing. After removal of the Air-Resistance-Wing 3*a* the same club is used to hit.

The Air-Resistance-Wing 3*a* may be used during play to build strength and to monitor one's swing. The Air-Resistance-Wing 3*a* is left on the club during play. The Air-Resistance-Wing 3*a* can also be used at the driving range in the same manner.

To remove the Air-Resistance-Wing 3*a*, a person needs to grasp it from either end and simply pull it off the golf club shaft, starting at either end of the Air-Resistance-Wing 3*a* and working toward the opposite end.

SUMMARY, RAMIFICATIONS, AND SCOPE

The reader will see that the Air-Resistance-Wing described in the above patent application provides the user with a simple means of adding additional power and accuracy to their golf swing, using the principle of progressive air resistance, from the attachment of a single device to the shaft of the golf club about to be played. The Air-Resistance-Wing can be used to warm up, on-the golf course or at the driving range. The Air-Resistance-Wing can be used as an exercise device by attaching it to the golf club while actually playing on the golf course or while practicing at a driving range or anywhere a golf club can be swung. The Air-Resistance-Wing will not interfere with the club head function when in use. The Air-Resistance-Wing attaches and detaches with ease and therefore can be used without slowing play for the user or others.

The Air-Resistance-Wing weighs less than six ounces, so it adds no additional weight to be contended with during the back swing or follow through movements of the swing. By creating resistance during those movements of the golfer's swing in which the club head is traveling through the critical pre-impact, impact, and post impact phases of the swing, the Air-Resistance-Wing provides resistance in amounts during that time as determined by the golfer himself. These time periods just mentioned, during the swing, are when the muscles, tendons, and ligaments of a golfer's body are participating in a coordinated effort to provide the proper swing technique to hit and direct the ball properly. It is important to build strength that is directly proportional and applicable to these phases of the golfer's swing. If the golfer practices the proper techniques to develop a precise swing, and uses our Air-Resistance-Wing simultaneously, he or she can develop increased strength and accuracy with little or no struggle which hasn't been offered before by any other golf training device. The rate of development is easily established by the user. The number of swings taken, and the speed at which the swings are taken, with the Air-Resistance-Wing attached, will directly affect one's results.

During the back swing and the first 50% of the attack phase of the swing, the Air-Resistance-Wing has little or no effect in regard to the resistance being produced. Little extra force is required to swing the club beyond the normal amount of effort required when the Air-Resistance-Wing is not in use. During the follow through phase of the swing, the effects are the same. Both of these situations are a direct result of the way the Air-Resistance-Wing is positioned on the golf club shaft, the configuration and weight of the Air-Resistance-Wing, and the position or angle of the club head during these swing phases.

When our Air-Resistance-Wing is used as a warm-up aid, the user quickly learns that the number of practice swings taken, in conjunction with the speed the club is swung, will create the desired effect which fits each golfer according to their own specific needs. After the warm-up swings have been taken and the Air-Resistance-Wing is removed, the user will notice the club swings with much greater ease, enabling the user to approach the shot to be taken with greater confidence and energy. Because the Air-Resistance-Wing can fit in the user's pocket, it does not become bothersome to attach and detach between shots. The Air-Resistance-Wing can be tossed aside when it is removed as it is easily and safely handled, no matter the choice of placement, directly before the shot is taken.

Although the description above contains many specificities they should not be construed as limiting the scope of our Air-Resistance-Wing, but merely provide illustrations of some of the presently preferred embodiments of the Air-Resistance-Wing. For example, the Air-Resistance-Wing could have other shapes, such as oval, circular, triangular, rectangular, etc; the lead in angle of the CLAMPING CHANNEL could be changed to many different opening configurations. The material used to shape the Air-Resistance-Wing could be die-cut or stamped out of aluminum, but not limited to, for special effects for advertising and promotional considerations. The material used could be a clear transparent type, and fluorescent, glow in the dark, applications can also be employed.

Thus the scope of our Air-Resistance-Wing should be determined by the appended claims and their legal equivalents, rather than by the examples given.

We claim and what we desire to be secured by Letters and Patent is as follows:

1. A golf device comprising a golf club having a club head and a club shaft, said club head having a face, an attachment adjacent the base of said club shaft, said attachment comprising a flexible, unitary, air-resistant blade having a channel extending the length of said blade along its center line, said club shaft being rotatably mounted in said channel so that the blade including the outer surface of said channel are aligned parallel to the face of the club head, said mounting being such that the blade will stay in the mounted position on the golf club shaft or will rotate depending on how the golf club is swung.

2. The invention according to claim 1 wherein the blade is made of polypropylene.

3. The invention according to claim 2 wherein the blade is made by injection molding.

4. The invention according to claim 3 wherein the blade comprises a main section and a tail section of smaller dimension mounted on the club with the main section at the lower position.

5. The invention according to claim 4 wherein the main section is bowed away from the face of the golf club.

* * * * *